United States Patent [19]

Kaski

[11] Patent Number: 4,621,583

[45] Date of Patent: Nov. 11, 1986

[54] SYSTEM FOR CONTROLLING A BARK-FIRED BOILER

[75] Inventor: Kalevi M. Kaski, Klaukkala, Finland

[73] Assignee: Measurex Corporation, Cupertino, Calif.

[21] Appl. No.: 750,341

[22] Filed: Jun. 28, 1985

[51] Int. Cl.[4] ..... F23D 1/00; F22D 37/42

[52] U.S. Cl. ..... 110/346; 110/347; 110/101 CF; 110/288; 122/449; 432/19

[58] Field of Search ..... 110/347, 346, 245, 101 CF, 110/288; 432/19; 122/449

[56] References Cited

U.S. PATENT DOCUMENTS

| | | | |
|---|---|---|---|
| 2,237,237 | 4/1941 | Scoggin et al. | 110/288 |
| 2,242,580 | 5/1941 | Foulds | 110/288 |
| 2,269,800 | 1/1942 | Wetzel | 110/288 |
| 2,385,811 | 10/1945 | Hotchkiss | 110/101 C |
| 3,966,560 | 6/1976 | Fanago et al. | 432/19 |
| 4,241,672 | 12/1980 | Tuttle | 110/346 |
| 4,385,567 | 5/1983 | Voss | 110/346 |
| 4,502,397 | 3/1985 | Hochmuth | 110/346 |
| 4,513,671 | 4/1985 | Eshleman | 110/101 CF |
| 4,528,917 | 7/1985 | Jacobs | 110/101 CF |
| 4,532,872 | 8/1985 | Anderson | 110/245 |

*Primary Examiner*—Henry C. Yuen
*Attorney, Agent, or Firm*—Hal J. Bohner

[57] ABSTRACT

A system and process for controlling a boiler is disclosed. The system includes a television camera mounted above the reciprocable grate of the boiler to locate craters in solid fuel on the grate and an actuator to vary an operating parameter of the furnace according to the location of the craters.

6 Claims, 3 Drawing Figures

SYSTEM FOR CONTROLLING A BARK-FIRED BOILER

BACKGROUND OF THE INVENTION

1. The Field of the Invention

The present invention concerns a system for controlling the operation of a bark-fired boiler. The system controls the position of the ash line and prevents craters in the bark.

2. State of the Art

In paper mills waste wood such as bark and wood chips is often burned, and the resulting heat is used to produce steam which in turn is used in the production of paper. Such boilers often have sloping grates upon which the wood is supported while it is burned. The bark is introduced onto the high end of the grate so that it travels downward while it is being burned. Air is introduced below the sloping grates so that the air travels upwardly through the bark thereby assisting combustion.

As the bark travels down the sloping grate the bark is often not uniformly disbursed across the grate. Where the bark is thinner air passes through the bark faster than where the layer of bark is thicker. This excess air enhances burning which in turn reduces the thickness of the layer of bark at the particular location thereby permitting additional increased air to flow through the bark. The result of this is that craters or holes can be formed in certain areas of the bark on the sloping grate while bark in other locations is only partially burned.

The formation of such craters or holes is undesirable since large quantities of air can flow through the craters and thereafter up through the furnace carrying large quantities of ash out of the boiler and through the stack. Also, these large quantities of air carry heat up the stack which is also undesirable. Presently operators of boilers watch for craters through ports in the boiler. If a crater is located, the operator alters the operation of the system to attempt to elliminate the craters.

Another parameter of interest in the operation of a bark-fired boiler is the location of the ash line. The ash line is essentially a line or zone of transition between burning wood and wood which has been burned to ash. It is normally preferable to operate the system with the ash line near the lower part of the grate so that the rate of through-put of bark is maximized. According to present practice the location of the ash line is observed by the operator of the boiler and manually controlled.

OBJECTS OF THE INVENTION

An object of the present invention is to provide a system and process for controlling craters and for controlling the location of the ash line.

Further objects and advantages of the present invention can be ascertained by reference to the specification and drawings herein which are offered by way of example and not in limitation of the invention which is defined by the claims and equivalents.

DETAILED DESCRIPTION OF THE PREFERRED EMBODIMENT

Figure 1:
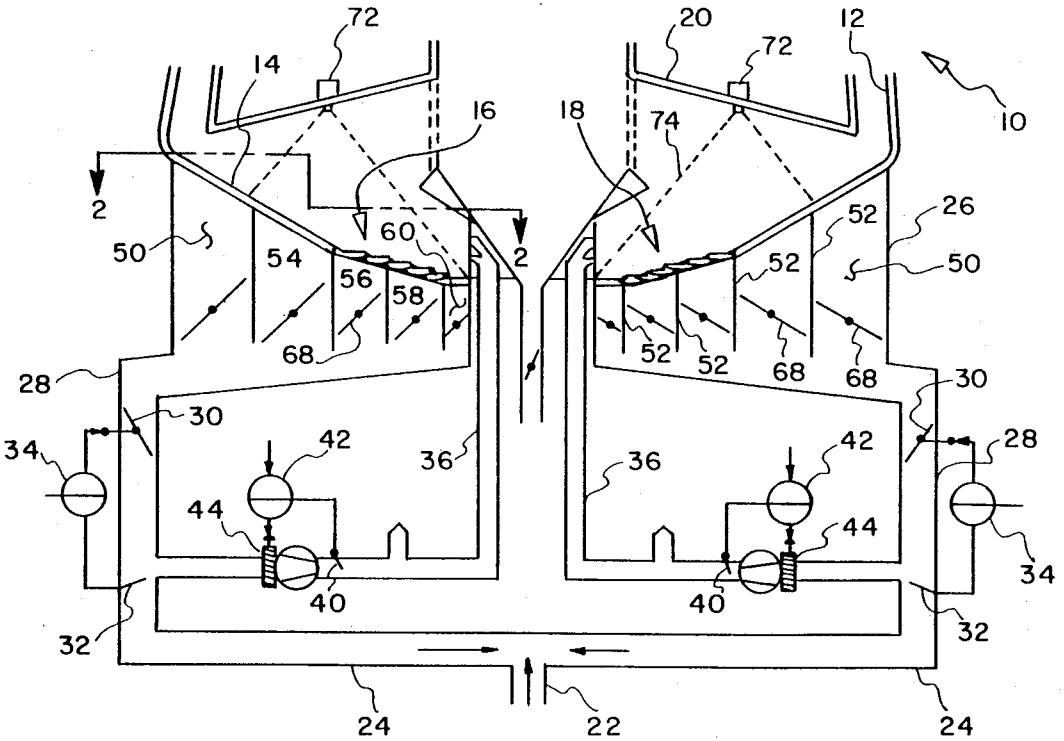
FIG. 1 is a schematic cross-sectional view of the lower part of a bark-fired boiler.

With reference to FIG. 1, only the lower part of the bark-boiler 10 is shown. The upper part of the bark-boiler 10 is conventional and for the purpose of clarity is omitted from the FIGS. and discussion herein. The lower part of the bark-boiler 10 includes a grate system coupled to side walls 12. The grate system includes sloping grate 14 connected to the side walls 12. The sloping grate 14 includes a plurality of hollow tubes which have water circulating in them to provide cooling. Coupled to the lower end of the sloping grate is a kablitz grate 16 which is conventional and includes a plurality of substantially horizontal bars which can be driven to reciprocate with respect to one another. The reciprocating motion is used to cause the bark to travel downward along the kablitz grate 16. Ash grates 18 are coupled to the kablitz grate 16 at the lower ends thereof. The lower part of the bark boiler 20 also includes heat exchangers 20, only the lower parts of which are shown.

An air distribution system is coupled to the bark boiler 10 below the grate system. The air distribution system includes a conduit 22 coupled to a fan, not shown. The conduit 22 is coupled to conduits 24 which are in turn coupled to air compartments 26 coupled to the grate system. (The configuration of the air compartments is described in further detail below with reference to FIG. 2.)

The conduits 24 are coupled to air compartments 26 by conduits 28. Controllable dampers 30 are located in conduits 28 to control the rate of flow of air through the conudits. Flow meters 22 are disposed in conduits 28, and the flow meters are coupled to controllers 34 which are coupled to receive set point signals. Thus the controllers 34 control the dampers 30 so that the rate of flow of air through the conduits 28 is maintained at or near the established set point.

Conduits 36 are coupled to conduits 28 to convey streams of air into the bark boiler above the sloping grates. Flow meters 40 and controllers 42 are coupled to valves 44 which control the flow rate of air through conduits 36 in substantially the same way as the controllers 34 control the flow rate of air through conduits 28.

The air compartment 26 is divided into seven separate compartments. Compartment 50 is located under the upper end of the sloping grate 14 and is bounded by the exterior wall of the air compartment 26 and an interior partition 52. A second compartment 54 is located below the sloping grate 14 and bounded by the partition 52 which forms a wall of compartment 50 and second partition 52. A third compartment 56 is located below the kablitz grate 16 and is adjacent to the second compartment 54. The third compartment 56 is bounded by the partition 52 which bounds compartment 54 and another partition 52. A fourth compartment 58 is located adjacent to the third compartment 56 and is bounded by two partitions 52. The fourth compartment 58 is located below the kablitz grate 16. A fifth compartment 60 is located below the ash grate 18 and is bounded by a partition 52 and the interior wall of air compartment 26.

Figure 2:
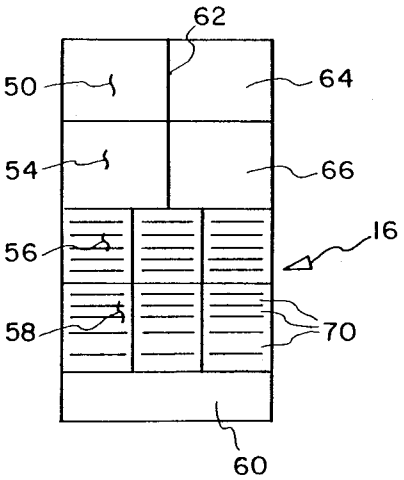
FIG. 2 is a schematic view of Section 2—2 in FIG. 1.

Turning to FIG. 2, which is a sectional view of FIG. 1 taken along line 2—2, there is shown a partition 62 which is located below the sloping grate 14 and bounds the compartment 50 and second compartment 54 to form two additional compartments 64 and 66. One damper 68 is located in each compartment 50, 54, 56, 58, 60, 64 and 66. The dampers 68 can be adjusted to control the flow of air through each compartment.

The kablitz grate 16 includes a plurality of flights 70 which can be reciprocated with respect to each other by a drive means, not shown.

Two video cameras 72 are mounted on the lower edges of heat exchanges 20. The camera 72 can be color or black and white and can be of the vacuum tube or semiconductor type. The video cameras 72 are positioned so that their fields of view encompass the lower parts of sloping grates 14 down to the lower ends of the ash grates 18. The field of view is indicated as 74 in FIG. 1.

When bark is introduced near the upper ends of sloping grates 14 it slides downwardly along the sloping grates while air is introduced upwardly through the air compartments. The bark is thereby provided oxygen to permit it to burn as it travels down the sloping grate and the kablitz grate 16 and onto the ash grate 18 wherefrom ash is removed through a duct, not shown.

Figure 3:
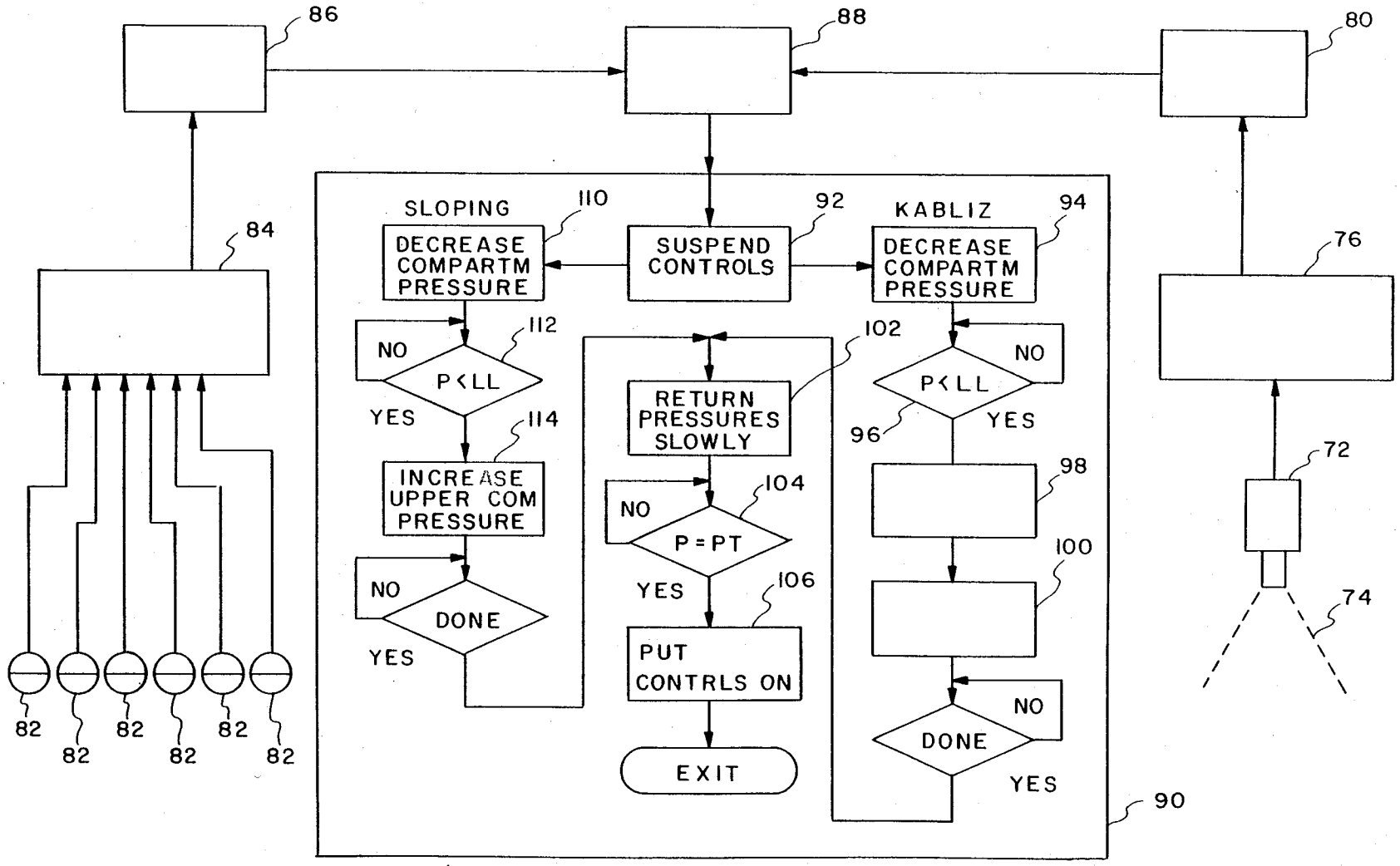
FIG. 3 is a schematic illustration of the present control system.

Turning now to FIG. 3 there can be seen a schematic illustration of the control system according to the present invention. The video cameras 72 receive light from the burning bark on the grates and convert the light into electrical signals indicative of the intensity of the light received from a particular area on the grate. The signals are transmitted to video camera interface electronics 76 which in turn transmit information to a computer system. The steps 80–90 which are discussed below, are performed by the computer system. The computer system calculates the coordinates of craters in step 80. Simultaneously, pressure measurement devices 82 located in the compartments 50–60 transmit pressure signals to the computer system. The computer system performs step 84 of determining the position of craters from the air compartment pressures. If there is substantial pressure drop in a compartment, the computer determines that this is due to a high rate of air flow through the bark bed due to a crater. It can be seen that step 84 merely determines whether there is a crater above any particular compartment. The computer system also performs step 86 of computing the crater coordinates based on signals from the video cameras 72. In step 88 the crater coordinates determined in steps 86 and 80 are compared. If the coordinates determined by steps 86 and 80 are the same, the computer concludes that the coordinates are correct. However, if the coordinates differ and continue to differ for more than a predetermined time an alarm is activated.

If it is determined that a crater exists at a particular point, the control scheme in step 90 is initiated. The normal control of the boiler is suspended (step 92) and a particular control scheme according to the present embodiment is instituted. If a crater is located on the kablitz grate, the first step is to decrease by a predetermined amount (step 94) the pressure in the compartment beneath the located crater. The compartment pressure is then tested against a lower limit (step 96) and if the pressure is not less than the lower limit the compartment pressure is again decreased and this step repeated until the pressure is below the lower limit. Once this has been accomplished, the pressure is increased (step 98) in the compartment immediately uphill of the compartment wherein the crater has been located. After step 98 has been completed, the rate of reciprocation of the kablitz grate is increased (step 100).

After step 100 has been completed control is slowly returned to the normal control scheme of the bark boiler (102) until the pressure in a compartment is equal to a target pressure (step 104). Thereafter the full control of the system is returned to the normal control scheme (step 106).

If a crater is found above the sloping grate, the pressure in the compartment above which the crater was located is decreased (step 110) by closing the damper in the compartment until the pressure is below a predetermined limit (step 112). Once the pressure has been reduced below the limit, the pressure is increased in the compartment immediately uphill of the compartment above which the crater is located (step 114).

Once step 114 has been completed, pressure is slowly increased (step 102) until pressure reaches a target. After this has been accomplished then full control is returned to the normal operating control of the system (step 106).

Ash line control is accomplished in a similar fashion to crater control. However, during the ash line control process the computer system determines the average intensity of light along a plurality of lines, each of which has a constant elevation along the grate. The computer then searches for a line which has significantly lower light intensity than the preceding uphill line. When such a line has been encountered, the computer determines that the ash line is somewhere between the line of high intensity and the line of low intensity.

Once the ash line position has been determined, the position is compared with a predetermined target for the ash line. If the actual ash line is too high, the rate of reciprocation of the kablitz grates 16 is increased thereby causing bark to slide down the grate more quickly. On the other hand, if the ash line is too low, the rate of reciprocation of the kablitz grates 16 is reduced.

It should be understood that although a bark-fired boiler has been discussed above, the present invention is also applicable to boilers which use other types of solid fuel such as coal or wood waste. Also, the boiler discussed above includes a sloping grate and a kablitz grate. However, the present invention is also applicable to boilers having other types of movable grates such as sloping grates and reciprocable mechanical grates as well as boilers having only traveling chain flight grates but not sloping grates.

I claim:

1. A system for controlling a boiler which burns solid fuel and which has a reciprocable grate, means for feeding solid fuel onto the grate to be burned, and means to controllably introduce air under the grate, the system comprising:

(a) light sensing means mounted above the grate and located to receive light from the solid fuel on the grate;

(b) control means coupled to receive signals from said light sensing means to determine, based upon the signals, the location of at least one crater in the solid fuel on said grate, and to generate signals indicative of the determined locations; and (c) actuator means, coupled to receive the signals indicative of the determined location from said control means, to vary an operating parameter of the furnace according to the determined location of the at least one crater in the solid fuel on said grate.

2. A system according to claim 1 wherein said actuator means is a draft controller coupled to the means to controllably introduce air under the grate, and said operating parameter of the furnace is the rate of introduction of the air.

3. A system according to claim 1 wherein said actuator means is a system to control the rate of reciprocation of the grate, and said operating parameter is the rate of reciprocation of the grate.

4. A system according to claim 1 wherein said control means determines the location of craters by determining the location where the brightness of light from the solid fuel is greater than the average brightness of light from a specified area of the fuel by greater than a predetermined value.

5. A system according to claim 1 wherein said light sensing means is a television camera.

6. A process for controlling a boiler which burns solid fuel and which has a reciprocable grate, a solid fuel feeder, an air introduction system and light sensing means mounted above the grate and located to view fuel on the grate, the process comprising:

(a) operating light sensing means to generate signals representative of the intensity of light emitted by the fuel at a plurality of locations on the grate;

(b) determining, based upon the signals from the light sensing means, the location of craters in the fuel on the grate and generating signals indicative of the determined location; and (c) controlling an operating parameter of the furnace in response to the determined location of the feature of the fuel on the grate.

* * * * *